US005254185A

United States Patent [19]

Schade

[11] Patent Number: 5,254,185

[45] Date of Patent: Oct. 19, 1993

[54] METHOD FOR PRODUCING A SURFACE-COATED COMPONENT, IN PARTICULAR A CONTACT PIECE FOR A VACUUM SWITCH, AND DEVICE FOR EXECUTING THIS METHOD

[75] Inventor: Ekkehard Schade, Baden, Switzerland

[73] Assignee: Calor-Emag AG, Ratingen, Fed. Rep. of Germany

[21] Appl. No.: 752,600

[22] PCT Filed: Dec. 17, 1990

[86] PCT No.: PCT/CH90/00285

§ 371 Date: Aug. 14, 1991

§ 102(e) Date: Aug. 14, 1991

[87] PCT Pub. No.: WO91/09409

PCT Pub. Date: Jun. 27, 1991

[30] Foreign Application Priority Data

Dec. 15, 1989 [CH] Switzerland ..... 4513/89-7

[51] Int. Cl.[5] ..... B05B 5/06; H01H 11/04

[52] U.S. Cl. ..... 148/512; 148/513; 148/525; 148/565; 118/320; 118/620

[58] Field of Search ..... 148/512, 513, 525, 565; 118/320, 620

[56] References Cited

U.S. PATENT DOCUMENTS

| | | | |
|---|---|---|---|
| 2,175,606 | 10/1939 | Kinkead | 118/620 |
| 3,770,497 | 11/1973 | Hassler et al. | 148/512 |
| 4,420,346 | 12/1983 | Belkin et al. | 148/512 |
| 4,750,947 | 6/1988 | Yoshiwara et al. | 148/525 |
| 5,084,113 | 1/1992 | Mori et al. | 148/525 |

FOREIGN PATENT DOCUMENTS

| | | | |
|---|---|---|---|
| 3541584 | 5/1987 | Fed. Rep. of Germany . | |
| 661616 | 7/1987 | Switzerland . | |
| 2047567 | 12/1980 | United Kingdom | 118/620 |

OTHER PUBLICATIONS

"(54) Welding Device", Patent Abstracts of Japan, vol. 10, No. 204, Jul. 1986, 61-46385.

"(54) Diffusion Joining Method", Patent Abstracts of Japan, vol. 8, No. 40, Feb. 1984, 58-196187.

"(54) Laser Beam Machine", Patent Abstracts of Japan, vol. 8, No. 40, Feb. 1984, 58-196188.

*Primary Examiner*—George Wyszomierski

*Attorney, Agent, or Firm*—Burns, Doane, Swecker & Mathis

[57] ABSTRACT

Surface-coated components, such as contact pieces for vacuum switches, are produced by means of the method by melting open the surface of a metallic substrate (1) in a local area (15) by an energy flow (12) and combining an additive (8) with the melted-open material of the local area (15). It is intended to produce components with large areas with small outlay in apparatus by means of this method. This is attained by the following steps: Prior to melting open the local area (15), the substrate (1) is pre-heated to a temperature considerably above room temperature, but below its melting temperature. After pre-heating, the local area (15) on the surface of the substrate is melted open and the additive (8) is applied to the substrate surface in the form of a loose powder layer (10). The local area (15) melted open by the energy flow (12) is guided to and through the powder layer (10) and in the course of this powder present in the powder layer (10) is wetted or the powder layer (10) is soaked with liquid material from the melted-open local area (15), because of which the powder of the powder layer (10) is bonded with the surface of the substrate (1) and the desired surface layer (16) is formed.

10 Claims, 2 Drawing Sheets

METHOD FOR PRODUCING A SURFACE-COATED COMPONENT, IN PARTICULAR A CONTACT PIECE FOR A VACUUM SWITCH, AND DEVICE FOR EXECUTING THIS METHOD

FIELD OF THE INVENTION

The invention relates to a method and apparatus for producing a surface-coated component, in particular a contact piece for a vacuum switch, consisting of a metallic substrate and at least one additive supplied to the substrate, where the surface of the substrate is melted open in at least one local area by means of a flow of energy and where the additive is combined with the molten material of the local area.

BACKGROUND OF THE INVENTION

The invention makes reference to a state of the art as disclosed, for example, in German Patent Disclosure DE-A1-3541584. A method disclosed in this patent publication is used for producing metal composites consisting of a basic material with at least one metal and further active components. In this case, a substrate made of a basic material is melted down to a preset depth in a locally selected area by means of radiant energy and the active component is supplied to the metal material. This requires radiation with very high beam current density, such as a laser beam, for example, and special energy transmission devices, by means of which the active component can be accelerated to high speeds.

It is known from Swiss Patent Disclosure CH-A5-661616 to expose a sinter body containing chrome and copper in a vacuum or an inert gas atmosphere to a highly concentrated heat flow, for example supplied by an electrical arc, having a beam current density of 10 to 1000 kW/cm$^2$. In the course of the application of the heating current, lasting approximately 21 to 100 ms, the surface of the work piece is melted open. By means of subsequent cooling of the sinter body at a speed of $10^4$to $10^5$ K/s, a contact piece for a vacuum switch is then formed, having a surface layer up to 3 mm thick and made of a finely dispersed copper-chrome material having a low gas content. Contact pieces produced in this manner considerably increase the operational reliability of vacuum switches, but require considerable apparatus outlay when producing contact pieces of large area.

SUMMARY OF THE INVENTION

It is the object of the invention to recite a method for producing a surface-coated component, particularly a contact piece for a vacuum switch, by means of which it is possible to produce even components with large areas with small outlay in apparatus.

This object is attained by use of a method in which a metallic substrate is pre-heated to a temperature that is considerably above room temperature, but below its melting point. After pre-heating of the surface of the substrate, a local area is melted open and an additive is applied to the substrate surface in the form of a loose layer of powder. The local area, which has been melted open by the energy flow, is guided to and through the powder layer and in this way powder present in the powder layer is wetted or the powder layer is soaked by the liquid material from the locally melted open area. As a result, the powder of the powder layer is bonded with the surface of the substrate and the desired surface layer is formed.

The apparatus for carrying out this method includes a support for the substrate and an additive supply device. A heat source is mounted in position to heat a local area of the substrate, and the supply device moves relative to the substrate to supply the additive after the local area has been heated. The support for the substrate may include a rotatable member.

With small outlay in apparatus, the method in accordance with the invention makes possible the production of surface-coated components which can be subjected to high loads. Small demands are made on the heating current source, because its beam current density can be kept low. Because of the low beam current density, evaporation and spattering of the additive is prevented to a large extent in the course of the production of the components. Thus, there is no interference with the desired stoichiometry of the surface layer. Surface layers up to several millimeters can be achieved without problems. Surface layers of this type are eminently suitable as arc contact layers of the contact pieces of vacuum switches, particularly when embodied in the form of copper-chrome layers.

BRIEF DESCRIPTION OF THE DRAWINGS

The invention will be described in detail by means of a preferred embodiment shown in the drawings, in which.

DETAILED DESCRIPTION OF THE PREFERRED EMBODIMENT

Figure 1:
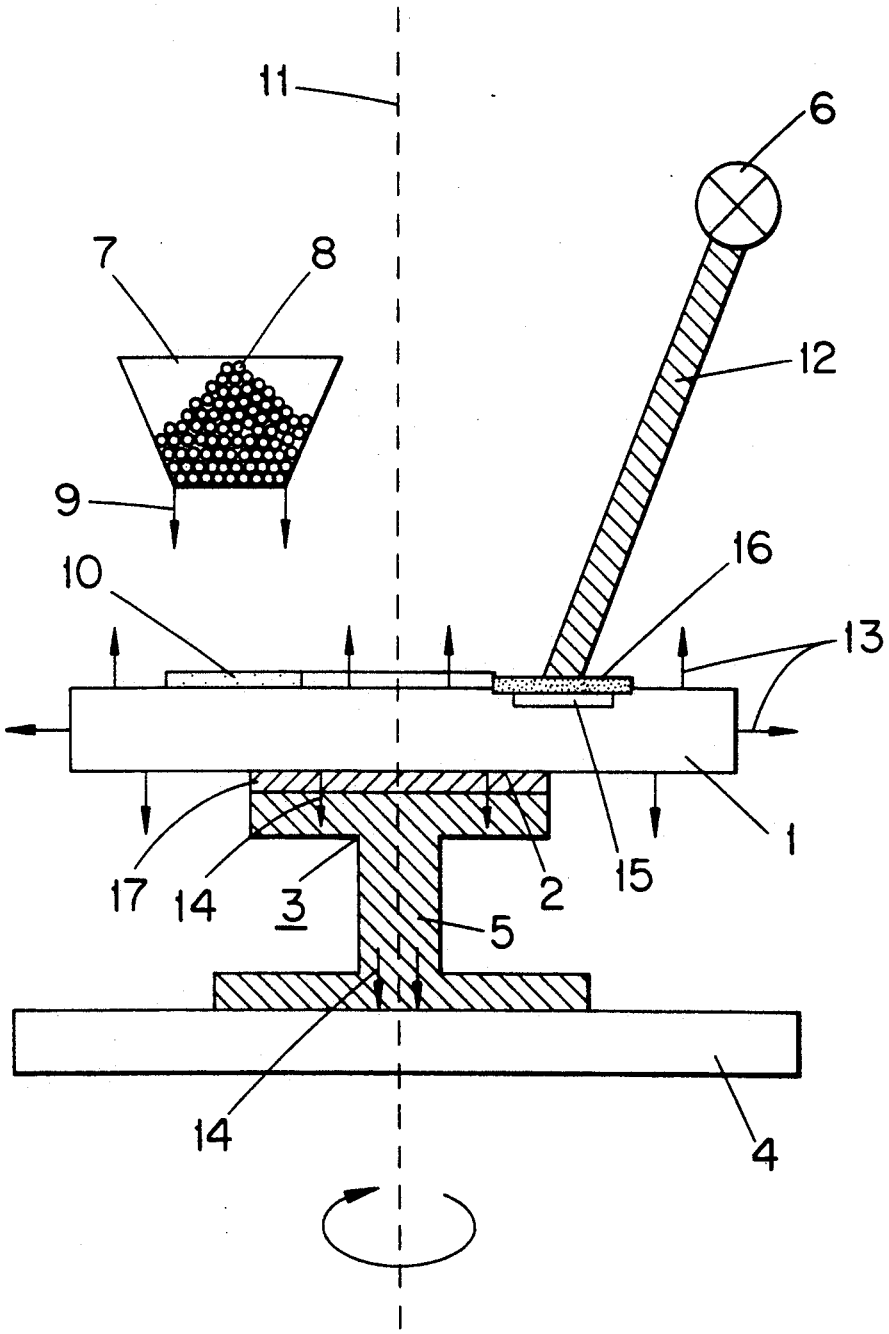
FIG. 1 is a side elevational view of apparatus for executing the method in accordance with the invention.

In the drawing figures, a substrate 1 is placed on a support surface 2 of a support device 3 embodied as a table or only as a column-shaped support. The substrate 1 is, for example, a copper disk with a diameter of approximately 40 mm and a thickness of approximately 8 mm, but may also be any other suitable metallic body. The support device 3 consists of, for example, a material which conducts heat well, such as preferably copper or silver, and has a support 5, seated on a water-cooled rotating device 4. A heating current source is indicated by 6. Advantageously, this heating current source emits high-energy particle radiation, such as electron or ion beams, however, it may also be embodied as a Hall generator or other suitable device. This heating current source advantageously has a beam current density from a few to some hundred Kilowatts per square centimeter. The heating current source advantageously has a total output from a few hundred Watts to approximately 20 Kilowatts. 7 indicates an additive supply device for receiving a powdery additive 8 which is sprinkled in the direction of the arrows 9 on the surface of the substrate 1, forming a powder layer 10. Preferably, the additive has a lesser heat conductivity than the substrate 1 and, when producing a contact piece for a vacuum switch having a backside mainly consisting of copper, it may contain chrome or an alloy on the basis of chrome and copper.

The method in accordance with the invention is executed as follows:

If, for example, it is intended to produce a contact piece for a vacuum switch as the component, the substrate 1, in this case mostly containing copper, the additive 8, in this case mostly containing chrome powder, and the heating current source 6, operating on the basis of electron beams, are contained in a vacuum of approximately $10^{-6}$ mbar. The support device 3 in this case rotates around an axis 11 in such a way that a mean advance of the substrate 1 in respect to the heating current source 6 of, for example, 5 to 10 cm/s is achieved. An energy flow 12, emitted by the heating current source 6, falls at the same time on a portion of the substrate surface. On impact this energy flow has a spread of, for example, 0.25 to 1 $cm^2$ and has a current density of, for example, 20 $kW/cm^2$ at the point of impact.

The energy flow 12 is almost totally absorbed by the substrate 1 and thus supplies heat to the substrate 1. Through heat conductivity, the heat supplied to the substrate 1 is transferred into the entire substrate 1 from the area of impact of the energy flow 12. By means of this, and because of the rotation of the substrate 1 as well as possible oscillation of the energy flow, overheating of the impact area is prevented. The substrate 1 is pre-heated in this manner to a temperature located considerably above room temperature, but below its melting point. With the previously described copper disk this pre-heating temperature is approximately 700° to 1000° C. During the pre-heating of the substrate 1, the output provided by the heating current source 6 is reduced. After reaching the pre-heating temperature, the beam 12 only has a current density of a few $kW/cm^2$.

As a result of the heat radiated from the surface (indicated by arrows 13) and heat conducted into the support surface 2 (indicated by arrows 14), this pre-heating temperature remains almost unchanged during the phase of the method in accordance with the invention to be described below. In this case it is possible to adjust the pre-heating temperature, with a pre-set output of the heating current source 6, by means of suitable heat transfer via the support device 3. For this purpose it is possible to maintain the support surface 2 at the desired temperature by a suitable increase or reduction of the cross-section of the support 5. It is recommended in a further embodiment of the invention to obtain the adjustment of the desired temperature by disposing between the substrate 1 and the support 5, leading to a cooling device, a part 17 made of a material which is comparatively less heat-conductive in respect to the remaining material of the support device 3, such as stainless steel, for example. Of course, the suitable adjustment of the temperature can also be achieved by simultaneous employment of both methods described above. In connection with a substrate 1, containing primarily copper and resting directly on the support surface 2, the support surface 2 should have a temperature of 500° to 600° C.

As soon as the pre-heating temperature has been reached, the comparatively small amount of energy provided to the substrate 1 by the energy flow 12 suffices to melt open the material in a local area 15. After the local area 15 has been melted open, the powder layer 10 is applied to the surface of the substrate 1. In case a chrome powder is used, having a mean particle size of approximately 100 μm, which is sprinkled from the additive supply device 7 in the direction of the arrows 9 on the substrate surface, the layer formed by loose powder typically is 25 to 50 $mg/cm^2$. The local area 15 is guided to and through the powder layer 10 by means of the rotation of the support device 3. Liquid material present in the locally melted-open area, such as copper, wets the powder present in the powder layer or, by means of the predominantly active capillary force, soaks the powder layer 10. If necessary, this effect can be increased by means of further additives.

Figure 2:
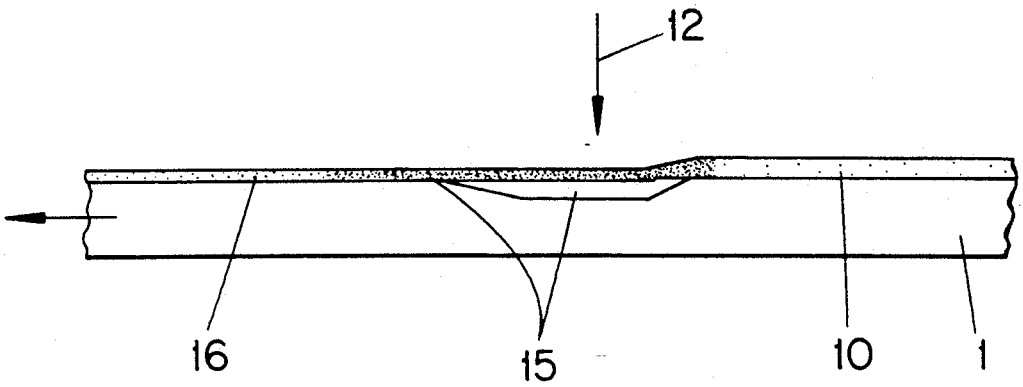
FIG. 2 is an enlarged vertical cross-sectional view of the apparatus of FIG. 1 at a location where a locally melted-open area 15 has been formed in the substrate 1 by means of a flow of energy 12.
Figure 3:
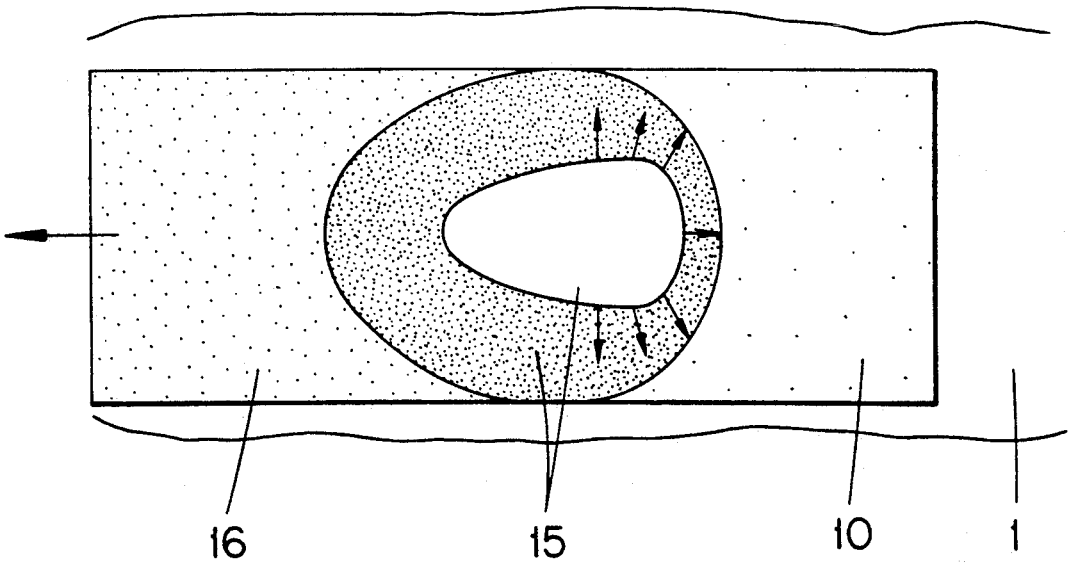
FIG. 3 is a top plan view of the area of the apparatus as shown in FIG. 2.

A surface layer 16 containing chrome and copper is created. Its formative mechanism, described above, can be seen particularly well in FIGS. 2 and 3. Since the energy flow 12 has a comparatively low energy density, overheating of the copper melt present in the local area 15 as well as of the chrome powder is avoided. Because the chrome powder only rests on the surface of the substrate 1, heat contact with the substrate is low, so that an intense energy flow would create extreme overheating. Evaporation or spattering of the chrome powder is thus prevented to a large degree.

It is possible to achieve the successive melting open and coating of almost the entire surface of the substrate 1 by means of the rotation of the support device 3 or of the heating current source 6 and of the additive supply device 7 around the axis 11, centrally leading through the support table 3 and extending vertically, or by additional movements performed radially, preferably oscillatingly, of the heating current source 6 and the additive supply device 7. It is, of course, also possible to perform the melting open of the substrate 1 by a translatory displacement taking place in the horizontal x-y plane where, for example, the heating current source 6 is guided back and forth between the edges of the substrate 1 in the x- and y-direction, and the support surface 2 is displaced in approximately the y- direction. In this case, the additive supply device 7 should be moved in accordance with its displacement during the rotation of the substrate 1. It is possible to create in this manner a surface layer 16 of approximately 50 to 100 μm thickness after a complete traverse of the free surface of the substrate 1. Among other things, this layer is distinguished in that the substrate 1, and thus also the surface layer 16, are gas-free to a large degree because of comparatively slow melting over a large area.

If the cross-section of the energy flow 12 is narrow, an almost complete coating of the surface can be achieved by additionally moving the heating current source periodically back and forth in addition to the displacement crosswise to and/or in the direction of the substrate 1.

By cyclical repetition of the method steps described above, it is possible to generate layer thicknesses of up to several millimeters without problems. Varied layer thicknesses and/or predetermined surface profiles can be produced by appropriate control of the output and current density of the energy flow 12, the heating time of the local area 15 and/or the amount of additive 8 supplied. Vacuum switches equipped with contact pieces produced in this manner show considerably improved breaking capacities in comparison with vacuum switches of comparative size but having contact pieces produced in accordance with conventional methods.

If required, it is possible to achieve further improvements of the breaking capacity by briefly heating at least a portion of the surface layer 16, at least over a portion of its outer surface and, starting from its outer surface, at least over a portion of its depth, to a temperature considerably above the melting temperature of the substrate 1.

While this invention has been illustrated and described in accordance with a preferred embodiment, it is recognized that variations and changes may be made therein without departing from the invention as defined in the claims.

What is claimed is:

1. A method for producing a surface-coated electric contact piece having a metallic substrate comprising heating a local area of the substrate to a temperature "several hundred °C." above room temperature, but below its melting point; coating the local area by applying an additive to the substrate surface in the form of a loose layer of powder; and applying additional heat to the local are to cause the substrate to be melted so that the powder present in the powder layer is wetted by liquid metal from the locally melted area, whereby the powder of the powder layer is bonded with the surface of the substrate and a surface layer is formed, the substrate being pre-heated by means of a heating current source which emits electrons and has a controllable beam current density, and during the pre-heating of the substrate the heating current source being operated with an output several times higher than during the coating of the local area.

2. A method for producing a surface-coated electric contact piece having a metallic substrate comprising heating a local area of the substrate to a temperature "several hundred °C." above room temperature, but below its melting point; applying an additive to the substrate surface in the form of a loose layer of powder; and applying additional heat to the local area to cause the substrate to be melted so that the powder present in the powder layer is wetted by liquid metal from the locally melted area, whereby the powder of the powder layer is bonded with the surface of the substrate and a surface layer is formed, the heating of the local area of the substrate being performed by a heating current source and the additive being applied to the substrate by an additive supply device, the heating current source being displaced periodically back and forth in addition to displacement crosswise toward and away from the substrate during the step of heating the local area of the substrate.

3. The method in accordance with claim 2, including displacing the additive supply device periodically back and forth crosswise to a displacement direction of the substrate during the step of applying the additive to the substrate surface.

4. A method for producing a surface-coated electric contact piece having a metallic comprising heating a local area of the substrate to a temperature "several hundred °C." above room temperature, but below its melting point; coating the local area by applying an additive to the substrate surface in the form of a loose layer of powder; and applying additional heat to the local area to cause the substrate to be melted so that the powder present in the powder layer is wetted by liquid metal from the locally melted area, whereby the powder of the powder layer is bonded with the surface of the substrate and a surface layer is formed, the substrate being preheated by means of a heating current source which emits electrons or ions and has a controllable beam current density, and during the pre-heating of the substrate the heating current source being operated first with an output several times higher than during the coating of the local area.

5. The method in accordance with claim 4, including applying a further powder layer to the surface layer for increasing its thickness.

6. The method in accordance with claim 5, including controlling the output and the current density of the heating current source, the heating time of the local area and the amount of the applied additive.

7. The method in accordance with claim 4, wherein the additional heating step includes briefly heating the substrate surface, at least over a portion of its outer surface and, starting from its outer surface, at least over a portion of its depth, to a temperature considerably above the melting temperature of the substrate.

8. The method in accordance with claim 4, wherein the step of applying additional heat begins prior to the step of applying the additive to the surface.

9. Apparatus for producing a surface-coated electric contact piece comprising: a heating current source; an additive supply device; a support device for a metallic substrate; and means for mounting the heating current source, the additive supply device and the substrate for displacement with respect to each other, the support device being rotatable and having a support surface for the substrate, and including means for adjusting the temperature of the support surface, the means for adjusting the temperature of the support surface including a part of the support device that has a low heat conductivity and including a cooling device.

10. Apparatus for producing a surface-coated electric contact piece comprising: a heating current source; an additive supply device; a support device for a metallic substrate; and means for mounting the heating current source, the additive supply device and the substrate for displacement with respect to each other, the support device being rotatable and having a support surface for the substrate, and including means for adjusting the temperature of the support surface, the means for adjusting the temperature of the support surface including means for changing the cross-section of the support device and including a cooling device for conducting heat from the support device.

* * * * *